US006702608B2

(12) United States Patent
Brennan, Jr.

(10) Patent No.: US 6,702,608 B2
(45) Date of Patent: Mar. 9, 2004

(54) ELECTRIC WORKSTATION WITH POWER REEL CORDS

(76) Inventor: Bernard A. Brennan, Jr., 1143 Oakwood Dr., Bogalusa, LA (US) 70427

( * ) Notice: Subject to any disclaimer, the term of this patent is extended or adjusted under 35 U.S.C. 154(b) by 200 days.

(21) Appl. No.: 09/858,774

(22) Filed: May 16, 2001

(65) Prior Publication Data

US 2002/0171998 A1 Nov. 21, 2002

(51) Int. Cl.[7] ..... H01R 13/72
(52) U.S. Cl. ..... 439/501; 280/47.19
(58) Field of Search ..... 280/47.17, 47.18, 280/47.19, 47.26, 47.27, 47.28; 439/501; 191/12.4

(56) References Cited

U.S. PATENT DOCUMENTS 4,457,527 A * 7/1984 Lowery ..... 280/47.19
4,520,239 A 5/1985 Schwartz
5,449,067 A 9/1995 Cannon
D365,012 S 12/1995 Sather
5,590,749 A 1/1997 Wagner et al.
5,738,423 A * 4/1998 Alfaro ..... 312/290
5,906,381 A * 5/1999 Hovatter ..... 280/47.18
5,917,694 A * 6/1999 Denny ..... 439/501
6,050,660 A * 4/2000 Gurley ..... 280/47.26
6,170,839 B1 * 1/2001 Kizewski ..... 280/47.19

* cited by examiner

*Primary Examiner*—Neil Abrams
(74) *Attorney, Agent, or Firm*—Keaty Professional Law Corporation

(57) ABSTRACT

An electric workstation in the shape of a hollow cabinet allows bringing electrical power connections to a site remote from a municipal electrical power supply. The cabinet is provided with one or more electrical sockets for connecting of electrically-powered tools and equipment, as well as one or more reels for holding electrical extension cords. A pair of front stationary legs and rotating wheels that allow easy moving of the cabinet to the desired location supports the cabinet. A handle secured adjacent the upper part of the cabinet allows to pull or push the cabinet when required.

6 Claims, 3 Drawing Sheets

ELECTRIC WORKSTATION WITH POWER REEL CORDS

BACKGROUND OF THE INVENTION

This invention relates to workstations, and more particularly, to a workstation that allows an operator to bring electrical connections, in an organized manner, closer to a job site.

Tradesmen and hobbyists have long used various workstations for storing small tools, equipment, supplies and other small items in drawers of a cabinet-like enclosure. These cabinets are usually of small size so that they can be transported easily from one site to another, as the job requires. Some of the workstations provide extendable top work surfaces, on which various drills, saws and other similar equipment can be permanently or detachably secured. Most of such workstations are designed for users working with wood or metal in a garage or a workshop.

Oftentimes, a craftsman or a tradesman requires a source of electrical supply at a location somewhat removed from the house AC power. The present invention is designed to provide such a workstation, allowing the user to conduct a variety of operations at a site distant from the source of AC power.

SUMMARY OF THE INVENTION

It is, therefore, an object of the present invention to provide a workstation for delivering electrical power to a job site located a distance from the conventional source of electrical power.

It is another object of the present invention to provide a workstation that is easily transportable to a job site.

It is a further object of the present invention to provide a workstation that organizes and stores electrical extension cords for use at a job site.

These and other objects of the present invention are achieved through a provision of a hollow cabinet that is formed by a front wall, two side walls, a rear wall and a top work plate. The front wall of the cabinet has a sliding drawer and a hinged door. One or more socket that can be connected to a source of AC power is provided on the front wall. At least one sidewall carries a reel for holding a length of an electrical extension cord. One end of the cord extends through an opening in the front wall, while the second end of the cord extends through an opening in the rear wall of the cabinet.

The cabinet is supported by a pair of front legs and a pair of rotating wheels mounted adjacent the rear lower portion of the cabinet. A handle secured on the sidewalls of the cabinet allows a user to tilt the cabinet backward, lifting the front legs off the ground and push or pull the cabinet on the wheels to a desired job site.

A battery may be positioned inside the cabinet to provide a source of DC power. A shelf located on a sidewall of the cabinet allows storing of small containers of supplies on the cabinet. A retainer member secured on the second side wall of the cabinet may be used for holding large size equipment, for instance a leaf blower. A second reel may be provided on the second wall for holding a second length of the extension cord.

BRIEF DESCRIPTION OF THE DRAWINGS

Reference will now be made to the drawings, wherein like parts are designated by like numerals, and wherein.

DETAIL DESCRIPTION OF THE PREFERRED EMBODIMENT

Figure 1:
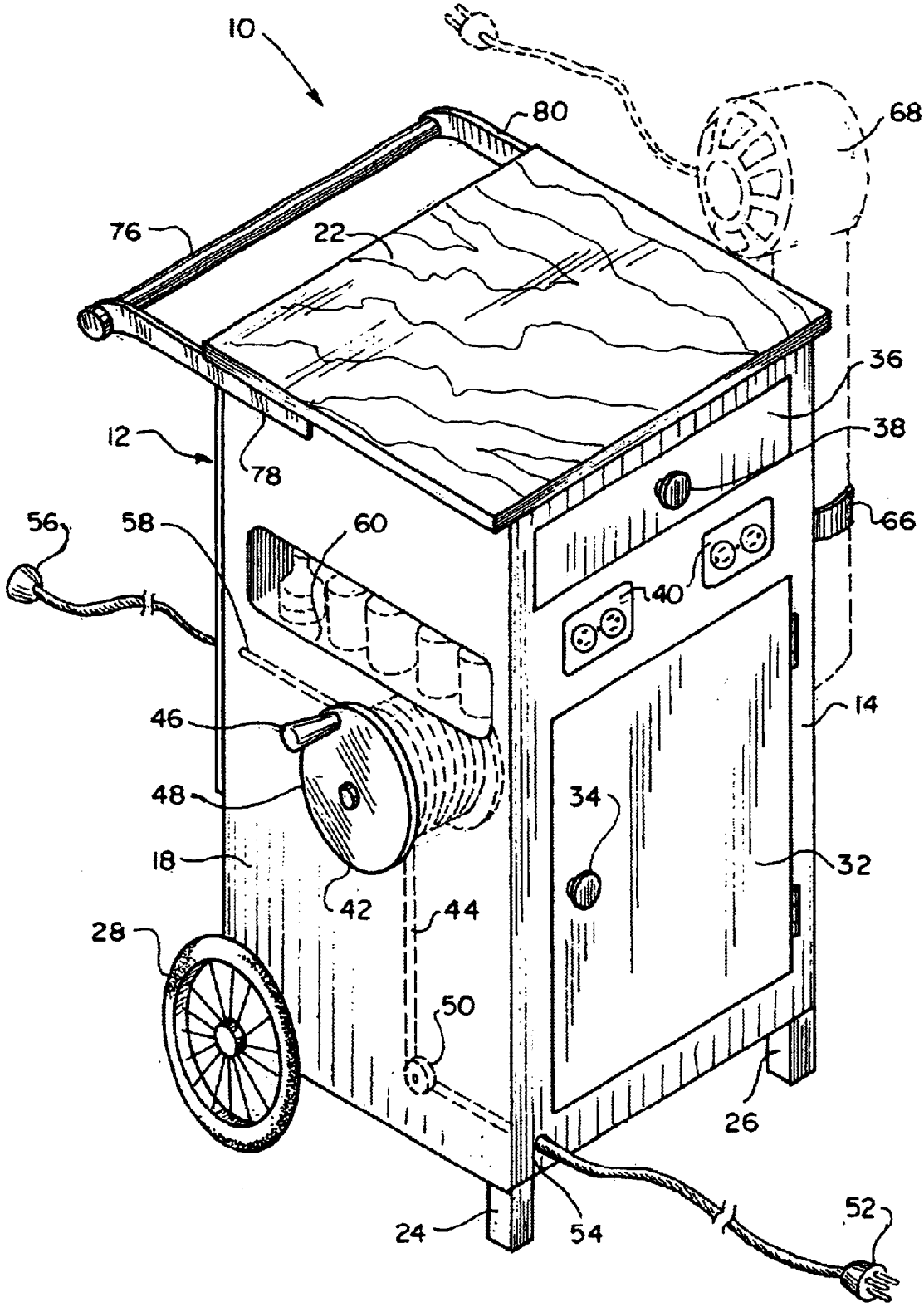
FIG. 1 is a perspective view of the workstation in accordance with the present invention.
Figure 2:
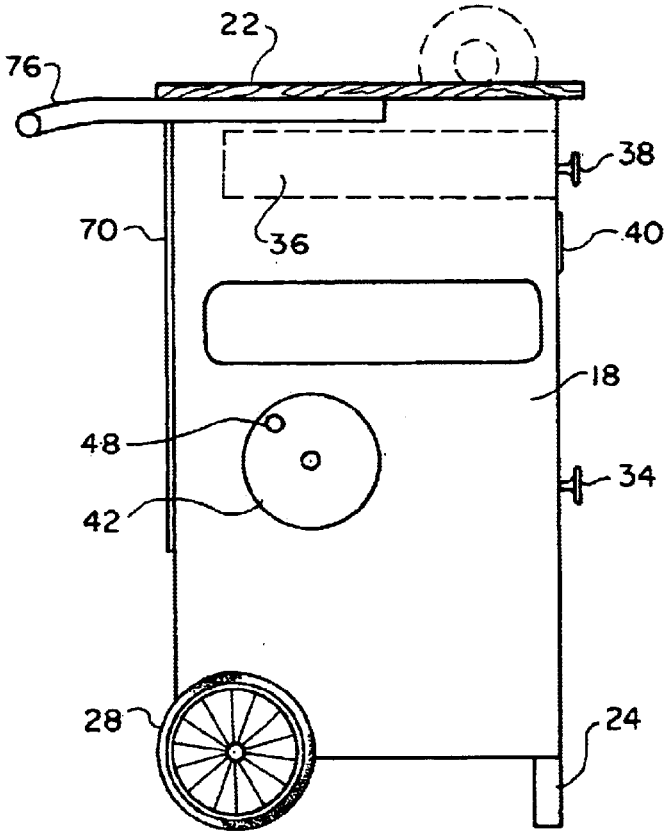
FIG. 2 is a side view of the workstation of the present invention.
Figure 3:
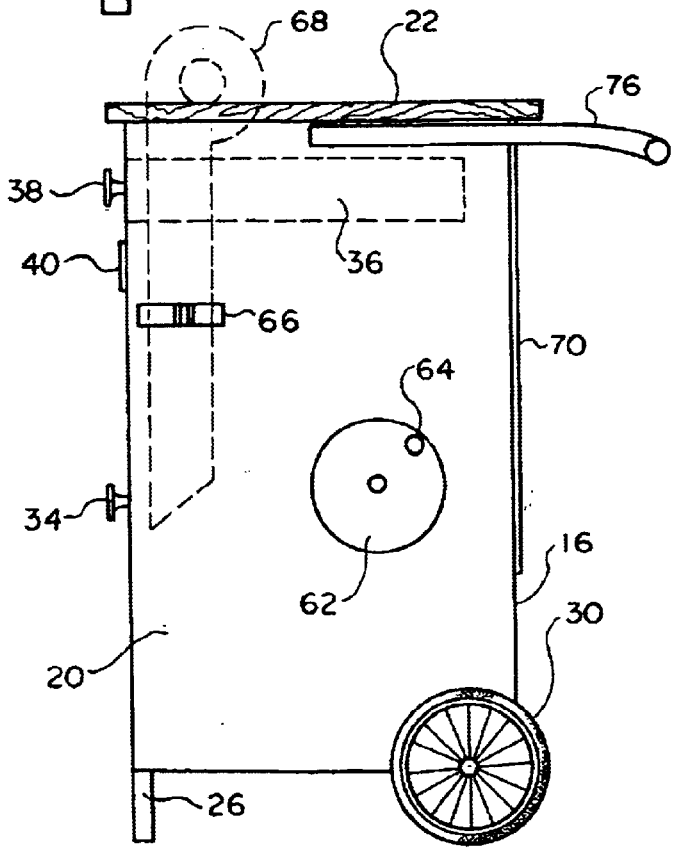
FIG. 3 is an opposite side view of the workstation.
Figure 4:
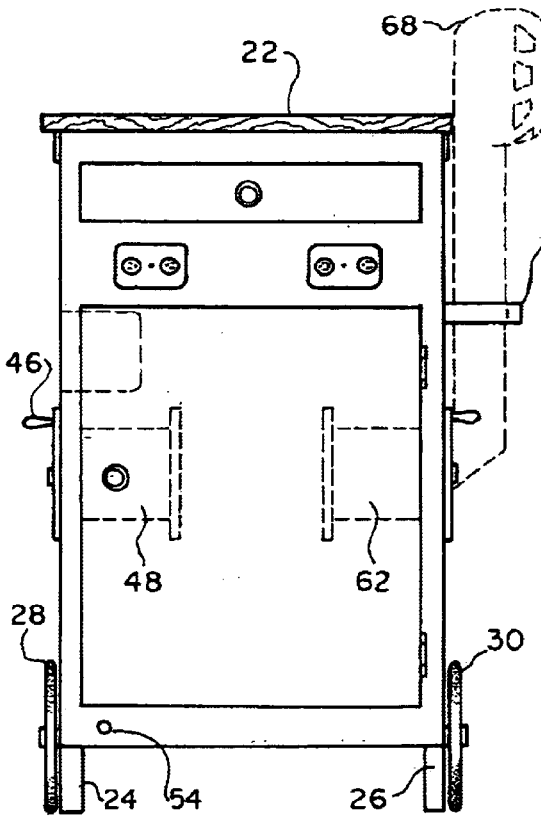
FIG. 4 is a front view of the workstation.
Figure 5:
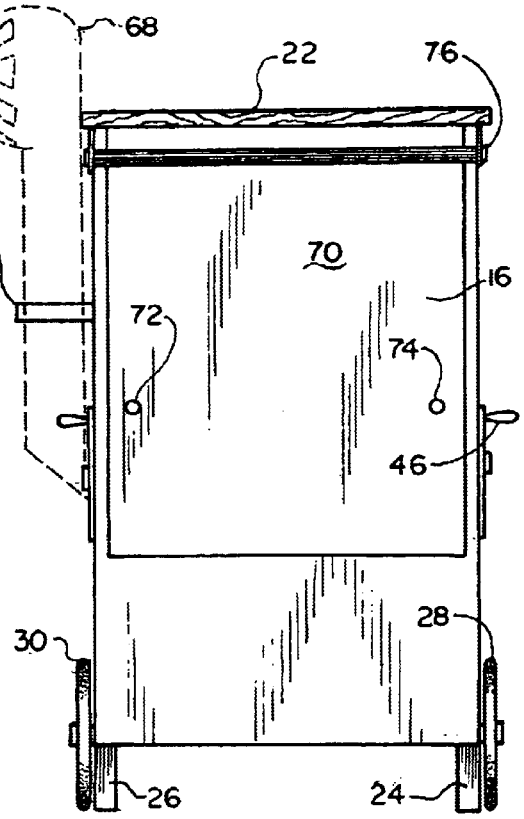
FIG. 5 is a rear view of the workstation.

Turning now to the drawings in more detail, numeral 10 designates the workstation in accordance with the present invention. The workstation 10 comprises a hollow cabinet-like enclosure 12 having a front wall 14, a rear wall 16, a first sidewall 18, a second sidewall 20, and a top wood surface 22. The cabinet 12 is supported by a pair of legs 24, 26 mounted at the front corners of the cabinet and a pair of rotating wheels 28, 30 mounted at the rear corners of the cabinet 12. When the cabinet 12 is stationary, the legs 24 and 26 rest on the horizontal surface, for instance, the floor of a workshop or the ground at a work site. When the cabinet 12 needs to be repositioned, the cabinet 12 is tilted backwards, lifting the legs 24 and 26 off the ground, and pushing or pulling the cabinet 12 on the supporting rotating wheels 28 and 30 to the desired location.

The front wall 14 of the cabinet 12 is provided with a hinged door 32 with a handle 34 to allow access to the interior of the hollow cabinet 12. A sliding drawer 36 is mounted in an upper part of the front wall 14. A pull knob 38 allows easy pulling of the drawer 36 and access to the interior of the drawer (now shown) when necessary. Small items, such as pliers, tape, wire, and other items may be stored in the drawer 36, as necessary.

One or more socket plates 40 are mounted below the drawer 36. The socket plates 40 can each carry one or more sockets, such as a 110-volt socket for connection of the electrically-powered equipment, when required. A cord (not shown) extending through the cabinet delivers AC power to the sockets 40, thereby allowing the user to connect any necessary equipment directly to the cabinet 12 at a remote site.

The first sidewall 18 carries the first electrical cord reel 42 adapted to receive a length of the cord 44 wound thereon. A handle 46 is secured on the reel plate 48 to allow winding and unwinding of the cord 44 upon demand. The handle 46 may be a ball-type handle so as to restrict its extension from the outside of the cabinet 12 and prevent "catching" against another object when the cabinet 12 is tilted and moved. The majority of the reel 42 is positioned inside of the hollow cabinet 12, wherein the cord 44 passes around the guiding wheel 50 located in a lower part of the cabinet 12 interior. As a result, the cord 44 exits the cabinet 12 a level close to the ground, which increases safety of the workstation. An opening 54 formed in the front wall 14 to allow the cord 44 to extend through the cabinet wall and make prong 52 accessible for connection to an AC municipal power source.

The second end of the cord 44 carries a female socket 56, to which electrical tools and equipment may be connected. A second opening 58 is made in the rear wall 16 of the cabinet 12 to allow the cord 44 to extend through the back wall of the cabinet.

A recessed shelf 60 is formed on the first side wall 18. Various small containers, for instance containing oil, lubricants, wax, and other substances, may be placed on the shelf 60 and be easily accessible to the operator. The containers are schematically illustrated in FIG. 1. The shelf 60 may be divided into individual compartments if desired so as to prevent the container from sliding when the cabinet 12 is re-positioned.

The second sidewall 20 of the cabinet 12 carries a second reel 62 that is similarly provided with a handle 64 to allow winding and unwinding of an electrical extension cord upon demand. Although not shown, an extension cord, similar to the cord 44 may be wound on the reel 62 and extend through the sidewall 20 or through the front wall 14 for connection to electrically powered equipment. A second guiding member, similar to the member 50 is provided inside the cabinet 12 to guide the second extension cord closer to the bottom and to a second opening (not shown) formed in the front wall 14.

A narrow retainer strip 66 is fixedly attached to the sidewall 20 above the midsection of the sidewall 20. The retainer 66 can be used for securing a large size tool or equipment, for instance a leaf blower 68. Of course, other tools and equipment may be positioned within the retainer 66, depending on the requirements of the user.

The back wall 16 of the cabinet 12 is provided with a detachable plate 70. A pair of openings 72, 74 are formed in the plate 70 to allow extension of the electrical extension cords 44 therethrough. Of course, the removable plate 70 is an optional feature and the back wall 16 may be simply a solid wall without a detachable portion, depending on the manufacturer's choice and customer demand.

Secured to the top of the sidewalls 18 and 20 is a U-shaped handle 76. The sides 78 and 80 of the handle 76 are fixedly attached to the sidewalls 18 and 20, respectively. The handle allows the user to tilt the cabinet 12 and push it or pull it, while the cabinet 12 is supported by the wheels 28 and 30. The handle 76 extends from the rear wall 16 of the cabinet 12.

The top plate 22 of the cabinet 12 forms a work surface on which the user can perform various tasks or use it for holding small tools and equipment. The size of the top plate 22 can be selected to closely accommodate the dimensions of the cabinet 12. Alternatively, the top plate 22 can be made interchangeable, allowing larger plates to be positioned on top of the cabinet 12 to form a larger work surface.

Figure 6:
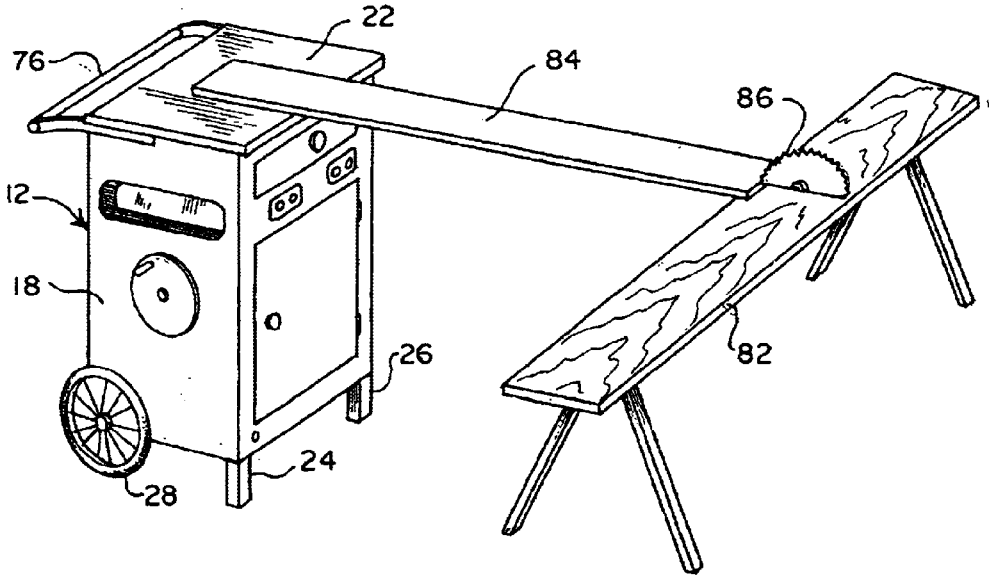
FIG. 6 is a perspective view of the workstation of the present invention serving as a support in cooperation with an independent workbench.

The height of the cabinet 12 is selected to approximate the height of other workstations and workbench products. FIG. 6 illustrates the use of the workstation 10 in combination with a workbench 82. A length of wood board 84 may be positioned with one end resting on the top plate 22, and the second end—on the workbench 82, if desired. The workbench 82 is shown as provided with a saw 86. It will be understood that the workbench 82 is presented for illustrative purposes only.

If a user desires to enlarge the work surface 22, the user may simply place a wide piece of plywood or other sturdy material on top of the plate 22. If the piece of plywood is too large, the second end of the piece may rest on a workbench, similar to the work bench 82, provided the work bench has an approximately the same height as the cabinet 12.

In operation, the user connects one of the cords to a municipal power supply. The user then moves the cabinet 12 to the desired distance and connects other equipment to the extension cord other end. One of the.

The workstation 10 can be manufactured from wood or metal. An optional source of direct current may be provided inside the cabinet 12. A rechargeable battery may be placed inside the cabinet 12; the battery (not shown) may be used for recharging electrically powered equipment. The DC power source can be 6–18 volts, depending on the user's s choice. The reels for the extension cords can accommodate various lengths of cords and can be made bigger, if desired, to accommodate a particularly long cord.

Many changes and modifications can be made in the design of the present invention without departing from the spirit thereof. I therefore pray that my rights to the present invention be limited only by the scope of the appended claims.

I claim:

1. A portable workstation for delivering electrical cables to a remote job site, said workstation comprising:

a hollow cabinet enclosure having a front wall, a first side wall, a second side wall and a top work surface;

a pair of legs secured to a front of the bottom portion of the enclosure;

a pair of rotating wheels securely attached to a rear of the bottom portion of the enclosure;

a sliding drawer mounted in a top portion of the front wall;

a hinged door located below said sliding drawer on the front wall of the enclosure;

at least one electrical socket mounted between said sliding drawer and the hinged door, said socket being electrically connectable to an electrical power supply;

a shelf mounted adjacent an upper part of the first side wall;

a first reel mounted below said shelf on the first side wall, said reel being provided with a handle for rotating the first reel, said reel being adapted for holding a length of an electrical extension cord wound thereon;

a second reel mounted on the second side wall, the second reel being provided with a handle for rotating the second reel, said second reel being adapted for holding a length of a second extension cord wound thereon;

a retainer member secured on the second wall for retaining a tool on an outside of the enclosure; and a handle for moving said enclosure to a desired job site.

2. The workstation of claim 1 wherein an opening is formed in a front wall of said enclosure below said door, said aperture allowing extension of a first end of an extension card therethrough.

3. The workstation of claim 2, wherein a second opening is formed in the rear wall of the enclosure to allow a second end of the extension cord to extend therethrough.

4. The workstation of claim 1, further comprising a guiding member mounted inside the enclosure, said guiding member guiding an extension cord from said first reel to the aperture formed in the front wall.

5. A workstation for carrying electrical connections to a remote job site, the workstation comprising:

a hollow cabinet enclosure having a front wall, a first side wall, a second side wall and a top work surface;

a pair of legs secured to a front of the bottom portion of the enclosure;

a pair of rotating wheels securely attached to a rear of the bottom portion of the enclosure;

a sliding drawer mounted in a top portion of the front wall;

a hinged door located below said sliding drawer on the front wall of the enclosure;

at least one electrical socket mounted between said sliding drawer and the hinged door, said socket being electrically connectable to an electrical power supply;

a shelf mounted adjacent an upper part of the first side wall;

a first reel mounted below said shelf on the first side wan, said reel being provided with a handle for rotating the first reel, said reel being adapted for holding a length of an electrical extension cord wound thereon;

a second reel mounted on the second side wall, the second reel being provided with a handle for rotating the second reel, said second reel being adapted for holding a length of a second extension cord wound thereon;

a retainer member secured on the second wall for retaining a tool on an outside of the enclosure;

a handle for moving said enclosure to a desired job site;

and wherein an opening is formed in a front wall of said enclosure below said door, said aperture allowing extension of a first end of the extension cord therethrough, and wherein a second end of the extension cord passes through an opening formed in the rear wall of the enclosure.

6. The workstation of claim 5, wherein said handle has a generally U-shaped configuration and extends outwardly from an upper part of the rear wall of the enclosure.

* * * * *